United States Patent [19]

Rice

[11] Patent Number: 4,887,700

[45] Date of Patent: Dec. 19, 1989

[54] LUGGAGE TO CARRY SUITS/DRESSES

[76] Inventor: Allen C. Rice, 101 Sixth St., Vidalia, Ga. 30474

[21] Appl. No.: 223,357

[22] Filed: Jul. 25, 1988

[51] Int. Cl.[4] ..... A45C 13/04; A45C 13/10; A45C 13/22

[52] U.S. Cl. ..... 190/111; 190/112; 190/903; 206/278; 206/284; 206/287.1

[58] Field of Search ..... 190/37, 109, 111, 112, 190/903; D3/71, 74, 76; 206/278, 287, 287.1, 288, 289, 290, 292, 284; 211/124

[56] References Cited

U.S. PATENT DOCUMENTS

| | | | |
|---|---|---|---|
| D. 292,745 | 11/1987 | Allen | D3/71 X |
| 2,689,631 | 9/1954 | Marks | 206/287.1 |
| 2,849,093 | 4/1958 | Chesnut | 206/292 |
| 3,021,930 | 2/1962 | Storey | 190/37 |
| 3,958,675 | 5/1976 | Rosenblum | 206/287.1 |
| 4,342,479 | 8/1982 | Hofer | 206/287 X |
| 4,598,803 | 7/1986 | Ghiassi | 206/287.1 X |
| 4,613,039 | 9/1986 | Shaw et al. | 206/287.1 |
| 4,729,460 | 3/1988 | Kim | 190/109 |
| 4,736,839 | 4/1988 | King | 206/287.1 |
| 4,753,342 | 6/1988 | Pulichino, Jr. et al. | 206/287.1 X |

FOREIGN PATENT DOCUMENTS

| | | | |
|---|---|---|---|
| 675746 | 5/1939 | Fed. Rep. of Germany | 206/289 |
| 838553 | 6/1960 | United Kingdom | 190/111 |

*Primary Examiner*—Sue A. Weaver
*Attorney, Agent, or Firm*—William F. Frank

[57] ABSTRACT

The present invention is luggage adapted to be folded in half to form what is generally referred to as a pullman case for hand carry or to be carried by a soft handle on one end as a garment bag. The end of the luggage with the soft carrying handle has a rigid plate extending the width of the luggage between the outer fabric covering of the luggage and the fabric liner, the covering and the liner being secured to the plate. The outer covering has a zippered pocket therein into which can be stored a hook and cable for hanging the luggage over a rod, door or wall hook. The inner surface of the luggage is closed by two zippers, each extending from the bottom of the luggage along each size and meeting at the top of the inner surface. The outer surface of the luggage carries two large pockets spaced apart at the central portion of the luggage length. Access to one of the pockets is by means of a single zipper extending the width of the pocket on its outer surface. Access to the other pocket is by means of two zippers, each extending along the pocket walls for a predetermined length. The central portion of the luggage between the two pockets has a second rigid plate between the outer covering and liner. A conventional luggage handle is secured to this plate as rings for attachment of a shoulder strap.

4 Claims, 3 Drawing Sheets

LUGGAGE TO CARRY SUITS/DRESSES

FIELD OF INVENTION

The present invention is in the general field of hand carried luggage. More specifically, the present invention provides improvements in luggage which is for the purpose of carrying suit-like garments, male or female, and for carrying garments such as dresses for women and full length coats for men.

BACKGROUND OF THE INVENTION

Hand carried luggage in its early stages comprised basically rectangular, hard-surfaced cases into which the clothes of the luggage carrier were folded so as to fit within the confines of the particular piece of luggage. The condition of the garments when unpacked can only be described as wrinkled, requiring pressing to remove the wrinkles. To reduce the wrinkling of garments as a result of being folded and placed in the luggage, luggage was developed which comprised a sheet or panel-like element about which a suit or dress could be folded so as to keep the general form of such garment flat on both sides of such panel. Such hard-surfaced cases did provide protection from external pressure on the garments contained therein. The hard-surfaced cases did prevent any additional creasing of the garments contained therein but also were heavy and by this very nature created weight limits for those travelling by air.

The weight problem was most conducive in the development of luggage of semi-rigid or limp fabric. Whereas the hard-surfaced luggage was shipped in the baggage compartment of aircraft, the fabric luggage offered the opportunity to carry the luggage onto the aircraft and hang it from the facilities provided on the aircraft. Such fabric luggage generally comprised a soft sided luggage which could be folded in half for carrying by the passenger and then could be hung at full length within the aircraft. Such carry-on luggage was ideal for carrying 1 or 2 suits or a few dresses which incidentally required a longer bag. However, if one was taking a trip of long duration vis-a-vis overnight or a few days, there was a need for luggage which could carry the suits/-dresses plus all the necessary accessories for multiple day visits or trips. Thus there was developed a luggage which could be carried on the aircraft and yet had a sufficient number of exterior and/or interior compartments to hold the necessary supply of shirts/blouses/-socks/undergarments/ shoes/stockings/toiletries/outer coats for rain protection and other personal items.

Such so-developed luggage had a basic structure of a hanging garment bag or the means on one end which could be placed over a hook, rod or even a door. Access to garments was by zippers opening each half of the top of the bag and running down each side of the extended bag. Such structures could provide interior storage on the lower end of the hanging bag for shoes or equivalents. Accessories as discussed previously were held in zippered/snapped/ buttoned pockets on the exterior of the basic structure. For compactness in carrying such a multiple container luggage, the luggage could be folded in half, being provided at the fold line with a handle for grasping and selectively a strap which could be placed over the user's shoulder. The luggage was more or less secured in the folded position reminiscent of a hard side suit case by straps/buckles/hooks/snaps or similarly active means. When the so-described luggage was in the form of the conventional garment bag, there was provided a loop or a hook of appropriate configuration attached to the upper end of the luggage by a chain or cable. When the such described garment bag was in the folded, transport position, the fabric loop was in dependent form subject to snagging any protruding object or the hook and cable/chain was hopefully restrained within the closure of the opposite ends of the garment bag. U.S. Pat. 4,342,479 discloses the provision of elements for holding the hook on hanging element on the exterior of the upper surface of a garment bag. It is to be noted that disclosed element can only be hung on a rod or a hook. Although such arrangement is an improvement over previously known garment bag suspension means, such arrangement is not absolute in preventing the hanging element from being disengaged and subject to subsequent catching on external objects.

SUMMARY OF THE PRESENT INVENTION

The present invention is luggage adapted to be folded in half to form what is generally referred to as a pullman case for hand carry or to be carried by a soft handle on one end as a garment bag. The end of the luggage with the soft carrying handle has a rigid plate extending the width of the luggage between the outer fabric covering of the luggage and the fabric liner, the covering and the liner being secured to the plate. The outer covering has a zippered pocket therein into which can be stored a hook and cable for hanging the luggage over a rod, door or wall hook. The inner surface of the luggage is closed by two zippers, each extending from the bottom of the luggage along each side and meeting at the top of the inner surface. The outer surface of the luggage carries two large pockets spaced apart at the central portion of the luggage length. Access to one of the pockets is by means of a single zipper extending the width of the pocket on its outer surface. Access to the other pocket is by means of two zippers, each extending along the pocket walls for a predetermined length. The central portion of the luggage between the two pockets has a second rigid plate between the outer covering and liner. A conventional luggage handle is secured to this plate as rings for attachment of a shoulder strap.

BRIEF DESCRIPTION OF THE INVENTION

The present invention is shown in FIGS. 1–3 which are illustrative of the principles of the construction of the invention but are not limiting as to the physical form of the invention.

DETAILED DESCRIPTION OF THE INVENTION

Figure 1:
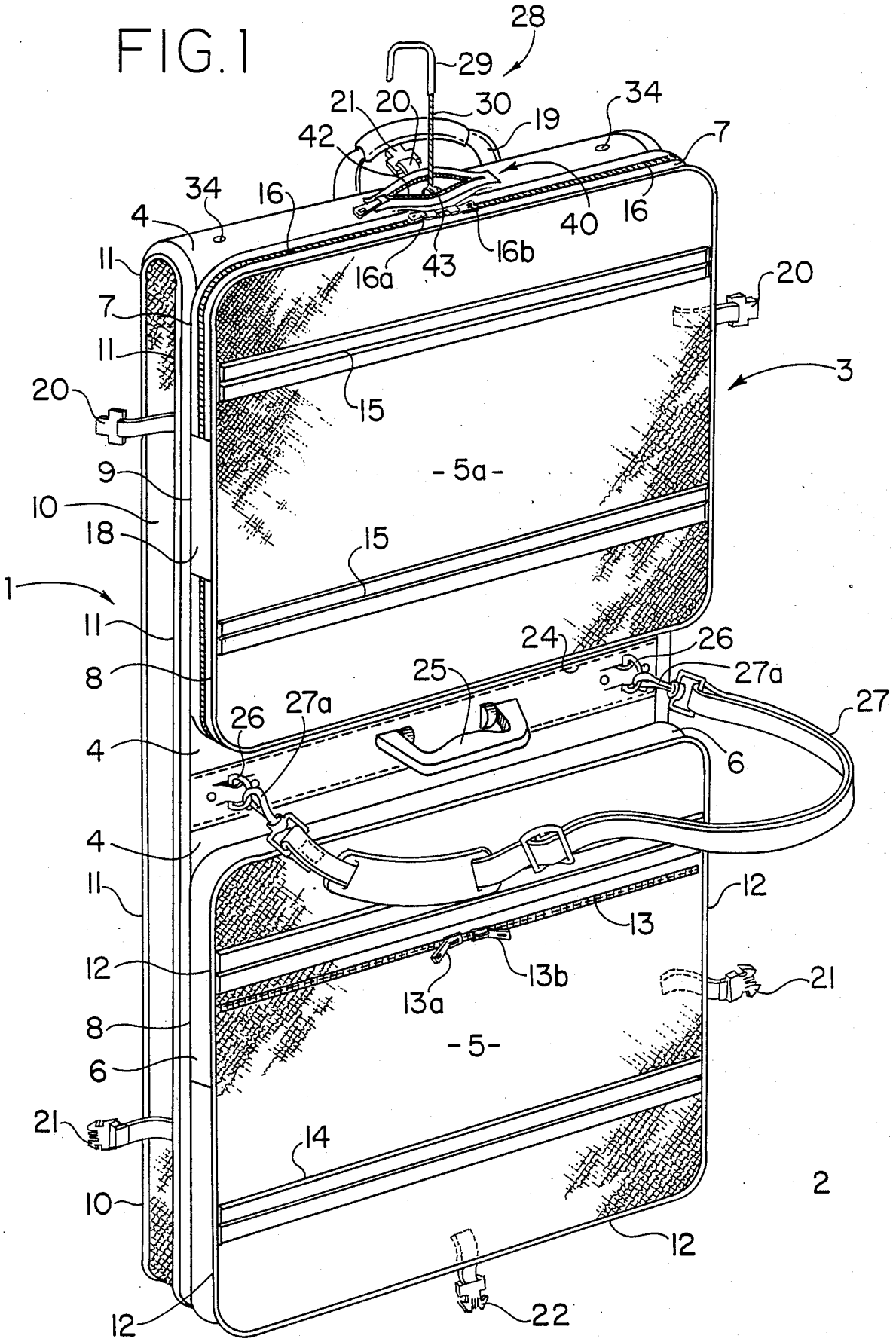
FIG. 1 is a perspective view of the present invention in the conventional garment bag position as to the exterior side of the invention, the interior side of the view being conventional.
Figure 2:
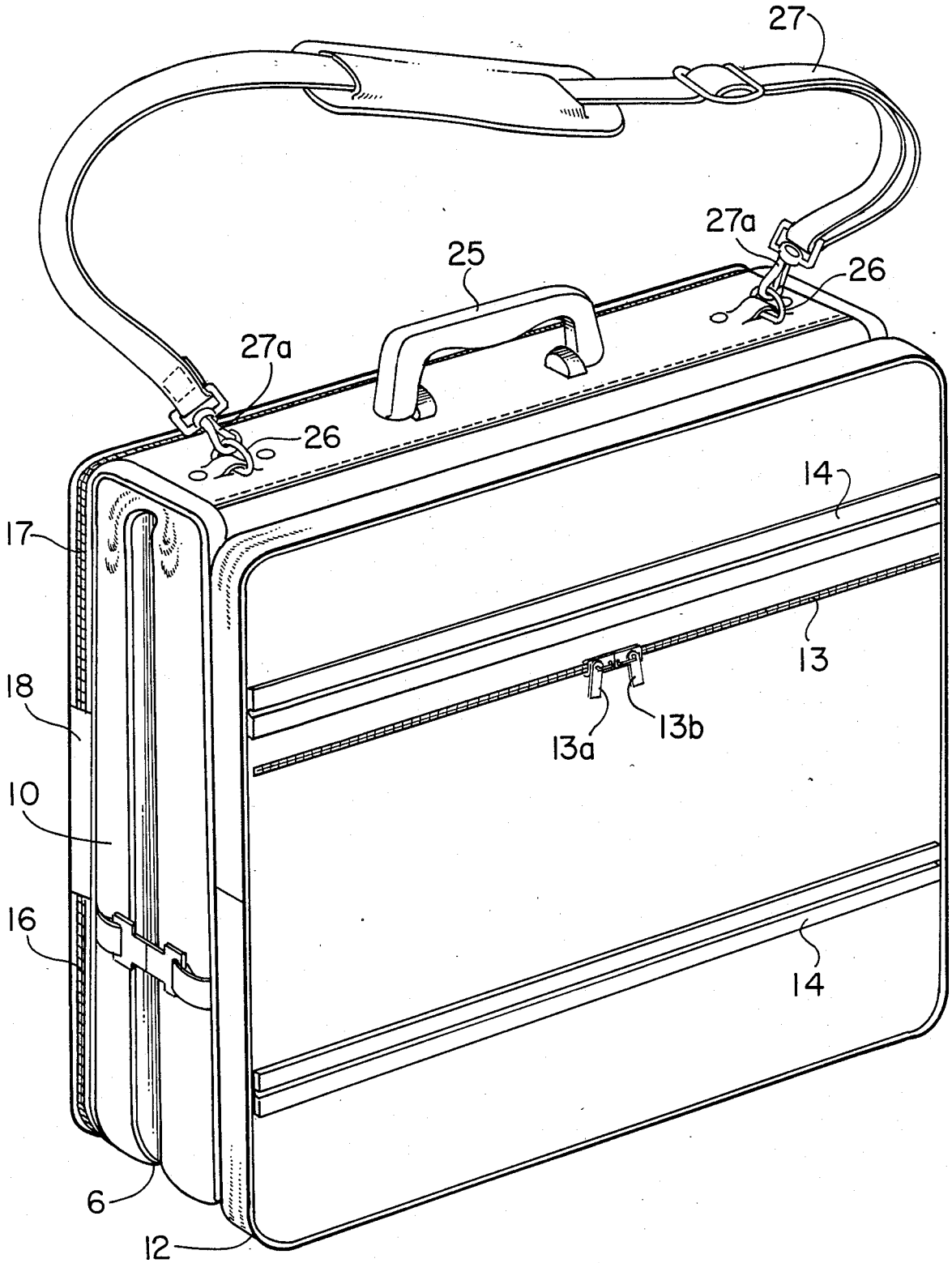
FIG. 2 is a perspective view of the present invention in conversion from a garment bag posture to that of the conventional pullman-type luggage.
Figure 3:
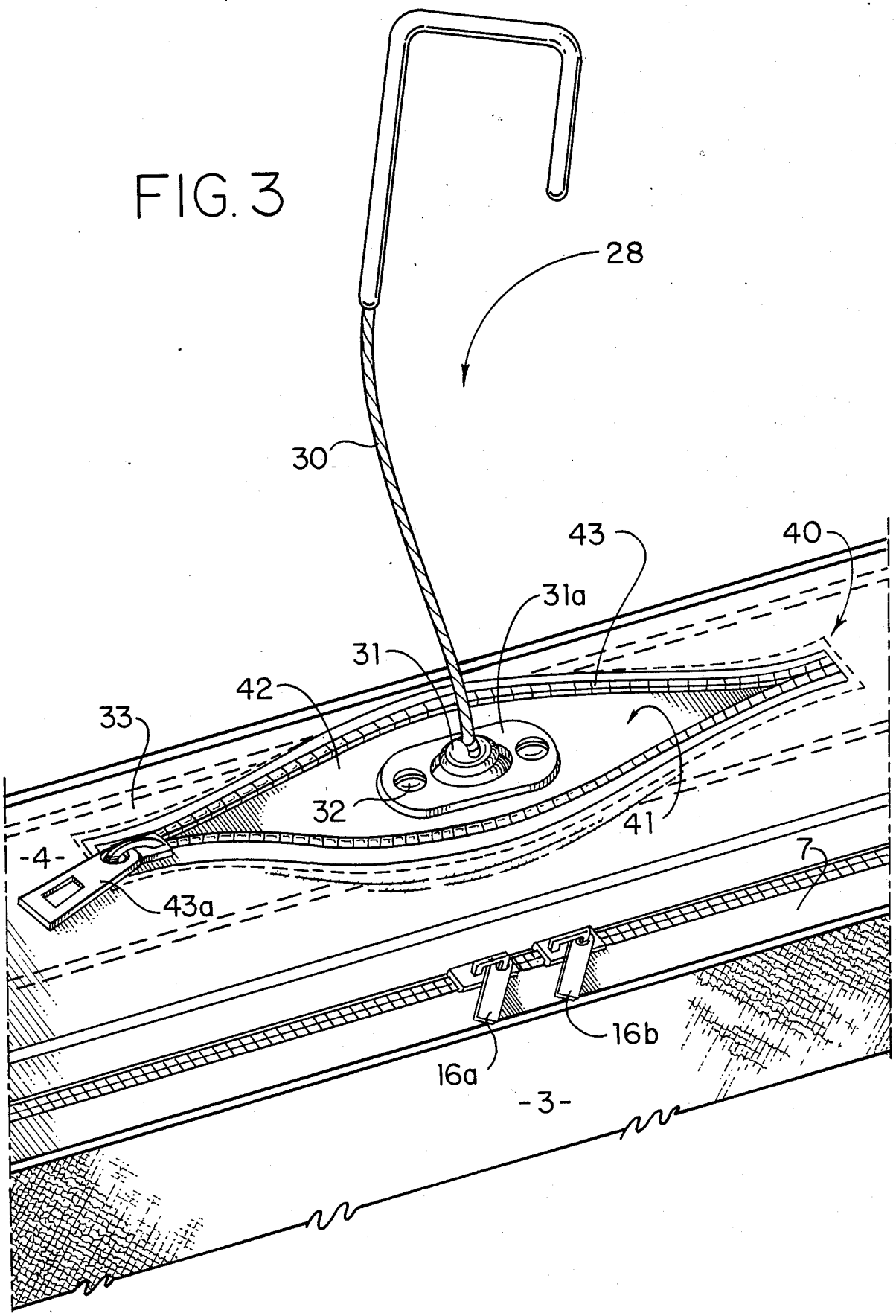
FIG. 3 is a perspective view of the novel arrangement for securing the hook hanger of a garment style luggage within the top inner surface thereof.

Referring to FIGS. 1–3, the present invention is an improved garment bag 1 seen in FIG. 1. As set forth in the description of the drawings, the interior side (not shown) of the bag 1 has two zipper elements each extending from the center of the upper end of the interior surface laterally and then longitudinally along the interior sides of the bag to its lower limits. The inner side is conventional and well-known and does not, per se, form a part of the present invention.

The exterior surface of bag 1 depicts structure not seen nor suggested by the prior art. The outer surface 4 of bag 1 comprises two outwardly extending equally sized pockets 2 and 3. Pockets 2 and 3 are formed by an outer surface 5 and 5*a* and a circumferential web 6 and 7 extending around the outer surfaces 5 and 5*a*. Inasmuch as the present invention relates to soft-sided luggage selected from such fabrics as canvas, rip-stop nylon, tweed-textured fabric and the like, it is to be understood the webs 6 and 7 of pockets 2 and 3 are permanently secured to the bags outer surface 4 by sewing or other equivalent securing means along seams 8 and 9 as exist and may be developed in the future.

It is to be noted that bag 1 has its inner (not seen) and outer surface 4 separated by a web 10 which provides the necessary depth of the bag to accommodate the garments to be held therein. The joining of the inner surface of bag 1 which is well-known and thus, per se, needs no further description with the outer surface by web 10 is accomplished by welt seams 11 which by known appearance as a bead provides an inherent, and at least partial, stiffening of the web and its juncture with the inner and outer surfaces to act as a resilient brace for the inner surface and outer surface 4 with web 10 to provide a flexible frame for bag 1.

Pocket 2 has an exterior circumferential welted seam 12 on its outer surface to provide a stiffening soft frame. Access to the interior of pocket 2 is provided by a zipper element 13 which extends laterally across the outer surface 5 of pocket 2. Zipper element 13 is a continuous zipper which can be opened from the center of pocket 2 by zipper tabs 13*a* and 13*b* each of which can also be moved along the entire length of zipper 13. The use of dual zipper tabs 13*a* and 13*b* permits opening of only one side of pocket 2 if desired. On the exterior surface 5 of pocket 2 there is provided two pairs of paired spaced apart soft-bodied stiffener ribs 14 extending across the width of pocket 2. The ribs 14 not only provide a bumper against contact by other luggage but also provide resilient strengthening of pocket 2. The ribs 14 are preferrably of sleeve-like structure with a foamed plastic of any well-known type as a filler for the ribs.

Pocket 3 carries on its outer surface 5*a* two pairs of spaced apart paired ribs 15 identical to ribs 14 on pocket 2. Access to pocket 3 is provided by zippers 16 and 17, each of which are secured in the upper portion of web 7 and the lower portion of web 7 as seen in FIG. 1 and FIG. 2. The fixed closed ends of zippers 16 and 17 are separated by web 7 reinforcement 18. Zippers 16 and 17 are continuous from end to end and each is provided with zipper tabs 16*a* and 16*b* and 17*a* and 17*b* (not so visible) so that only a portion of either end of pocket 3 can be partially opened if desired. It is to be understood that all the zipper tabs can be moved along the length of the respective zipper if so desired.

Bag 1 is provided with a soft handle 19 for carrying the luggage of the present invention by hand as a garment bag, the configuration seen in FIG. 1. For carrying the luggage of the present invention as a pullman-type, seen in FIG. 2, there are provided strap and buckle means 20 and 21 and 22. Strap and buckle means 22 retain handle 19 on the interior of the bag in the pullman case mode so as to prevent the handle 19 from snagging any object. Further supplementing the luggage of the present invention in the pullman case mode it will be noted the pockets 2 and 3 are separated in the central portion 23 of the bag 1. The central portion 23 has a rigid plate 24 seen as dotted lines secured between and to the outer surface 4 of the bag 1 and the lining thereof. Plate 24 provides support for securing handle 25 to be used in carrying the luggage in the pullman case mode and also to provide support for securing rings 26 to which an adjustable shoulder strap 27 may be attached by hooks 27*a* on strap 27.

Additional innovation in the present invention is the means for hanging bag 1 in the FIG. 1 mode from a door, hook or rod is a hook assembly 28 and storage means 40. Hook assembly 28 comprises a U-shaped rectangularly configured hook 29 which as can be seen will suspend bag 1 from the top surface of a door or a rod or hook. The hook 29 is attached on one end to a cable or chain 30, the other end of cable or chain 30 terminating in a ball 31 swivellingly retained in capped fitting 31*a* which in turn is secured by screw or any other well-known means 32 to a rigid plate 33 which is interposed between the outer surface 4 of bag 1 and a liner (not shown) and secured to the liner and outer surface by appropriate means thus stated as 34 on the end of bag 1 which is at the outer terminus for pocket 5*a*. Hook assembly 28 can be placed in storage means 40 in a pocket 41 formed in the end of bag 1 which is at the aforesaid outer terminus of pocket 5*a*, which pocket is formed by opening 42 between plate 33 and surface 4 which can be closed by zipper 43 when hook assembly 28 is inserted therein. Any changes as may occur to those of skill in the luggage art which retain and encompass the principles of the present invention are considered to fall within the scope of the following claims.

What is claimed is:

1. Luggage convertible between a garment bag mode and a pullman case mode comprising an inner surface carrying two opposing opening zippers, each zipper originating at the center of an upper end of said luggage and terminating along the outer sides of said inner surface at a bottom end of said surface; an outer surface of wear-resistant fabric, said outer surface having a pair of pockets secured thereto in a spaced relationship about a central portion of said outer surface, said inner surface and said outer surface of said luggage being joined by a web extending therebetween by welted seams to form a flexible frame along sides and top and bottom of said inner and outer surfaces; each of said pockets having two pairs of spaced apart adjacent outwardly projecting soft ribs extending across the widths of said pocket; each of said pockets having an outer surface joined to said bag outer surface by a web forming pocket sides with said pocket outer surface and secured to said pocket outer surface by a welted seam to form a flexible frame for said pocket, one of said pockets having opening means extending across the width of said one pocket, the other of said pockets having two opening means in said second pocket web, said opening means having spaced apart terminals, said opening means providing access to the interior of said other pocket from either of two opposing sides; the welted seam joining said outer surface of said luggage and said related web carrying a plurality of straps and hooks to secure said luggage in said pullman case mode; said central portion of said outer surface having first means to carry said pullman mode luggage by hand and second means to carry said pullman mode luggage by a shoulder strap means; means secured to said upper end of said luggage to carry said luggage by hand in said garment bag mode;

and means within said upper end of said luggage in said upper end to selectively store means to hang said luggage in said garment bag mode over a door, hook or rod, said storage means in the said upper end of said luggage comprising a zippered opening forming a pocket disclosing a rigid plate therein extending the width of said luggage between said outer surface and a lining for said luggage and secured thereto, a U-shaped rectangularly configured hook attached at one end to a cable or chain, the chain or cable other end terminating in a ball swivellingly retained in a capped fitting having a diametral slot therethrough to permit said hook and cable or chain to be stored within said storage means, said fitting being secured by known means to said rigid plate.

2. The luggage according to claim 1 wherein the opening means on said one pocket extending across said one pocket comprises zipper means including two zipper tabs each of which is adapted to said zipper means to permit each tab to open a portion of said zipper means or to open the full length of said zipper means to permit access to the interior thereof.

3. The luggage according to claim 1 wherein said opening means on said other pocket comprises two zipper means, one in each side web of said other pocket, each of said zipper means including two zipper tabs, each of which is adapted to said zipper means to permit each tab to open a part of an upper or lower portion of said respective zipper means or to open the entire length of said respective zipper means in said side web in permit access to the portion of said pocket adjacent said respective zipper means.

4. An improvement in a garment bag style of luggage having an upper end for hanging said luggage from a door, hook or rod comprising a rigid plate extending the width of said luggage between the luggage outer surface and at least a lining within said upper end and secured to said outer surface and said lining, a zipper opening in said upper end outer surface to provide a storage pocket for a hook element attached to one end of a flexible cable, the other end of said cable being swivellingly retained in a slotted capped fitting secured to said rigid plate.

* * * * *